United States Patent [19]

Black

[11] Patent Number: 4,785,769

[45] Date of Patent: Nov. 22, 1988

[54] REFRACTORY LINED BODIES

[75] Inventor: William B. Black, Bridge of Weir, Scotland

[73] Assignee: W. B. Black & Sons (Holdings) Limited, Scotland

[21] Appl. No.: 22,013

[22] Filed: Mar. 5, 1987

[30] Foreign Application Priority Data

Feb. 18, 1987 [GB] United Kingdom ..... 8703799

[51] Int. Cl.[4] ..... F22B 37/00

[52] U.S. Cl. ..... 122/6 A; 110/324; 110/335; 122/235 A; 122/510

[58] Field of Search ..... 122/6 A, 453, 510, 511, 122/512; 110/331, 332, 333, 334, 335, 336, 337, 338, 339, 322–324; 165/162; 52/506; 432/233, 238

[56] References Cited

U.S. PATENT DOCUMENTS

| | | | |
|---|---|---|---|
| 1,811,373 | 6/1931 | Thayer | 122/6 A |
| 1,909,448 | 5/1933 | Bailey et al. | 122/6 A |
| 3,220,367 | 11/1965 | Stein | 110/335 |
| 3,343,319 | 9/1967 | Reihtjes | 110/336 X |
| 3,838,665 | 10/1974 | Astrom | 122/6 A |
| 4,019,468 | 4/1977 | Miles | 122/51 D |
| 4,136,625 | 1/1979 | Corbet et al. | 110/339 X |

FOREIGN PATENT DOCUMENTS

| | | |
|---|---|---|
| 335451 | 9/1930 | United Kingdom . |
| 336520 | 10/1930 | United Kingdom . |
| 339055 | 12/1930 | United Kingdom . |
| 362342 | 11/1931 | United Kingdom . |
| 1291402 | 10/1972 | United Kingdom . |
| 1433823 | 4/1976 | United Kingdom . |
| 1585255 | 2/1981 | United Kingdom . |

*Primary Examiner*—Steven E. Warner

*Attorney, Agent, or Firm*—Gerald J. Ferguson, Jr.

[57] ABSTRACT

A burner throat is defined by a cage of tubes and is lined by fitting refractory tiles. A plurality of retaining means each having two joined parts, the outer part abutting the tubes and the inner part exerting an abutting force radially inwards on the tiles to retain them in position. In use the abutting force on the tiles can be varied to suit the design characteristics and environment, by varying the exposed length of a pin which threadedly mates in a complementary bore in each of the two parts. To further secure the tiles, a dowel is provided to mate in complementary bores formed in an adjacent side of abutting tiles.

7 Claims, 2 Drawing Sheets

REFRACTORY LINED BODIES

DESCRIPTION

The present invention relates to refractory lining, and more particularly to retaining fitting refractory tiles in position as the lining of a burner throat.

Refractory tiles are often fitted on the hot side of water tubes within a furnace, burner throat or the like. In, for example, a furnace wall the tiles are clamped in position via clamps to yolks which are fitted around the tubes. Examples of this can be found in GB No. 1433823 (Gotaverkens) and U.S. Pat. No. 3,838,665 (Anstrom).

However, in systems such as these access to the cold side of the tubes is essential to fit the clamps. In U.S. Pat. No. 4,136,625

Corbet et al (Poulton) shows a method of fixing the tiles by welding, to the tubes, bolts so as to extend inwardly. The bolts can then be used to anchor tiles to the tubes in a tensional arrangement. Not only have the tiles, however, to be specifically designed to engage with the bolts, but also the bolts have to be individually welded to the tubes, which could damage the tubes.

It is an object of the present invention to obviate or mitigate the aforesaid disadvantages.

According to the present invention there is provided a generally arcuately shaped body comprising a generally arcuate cage of tubes in which access to the cold side thereof is restricted; an inner lining of fitting refractory tiles laid in circular courses along the axis of the arcuate cage of tubes; each course having a plurality of joining means between abutting tile edges to prevent relative movement of said tile edges; the arcuately shaped body having a plurality of non-permanently fixed and adjustable retaining means located between the tubes and tiles so as to exert an abutting force radially inwards on the tiles and thereby retain them in position.

By non permanently fixed we mean not welded to the tubes.

The advantages of the invention is that refractory titles can now be laid from the inside of arcuate bodies, where access to the cold side of the tubes is otherwise restricted. More particularly there is now no need for the welded bolts which risks damaging the tubes.

Preferably the arcuate body is a burner throat for a furnace.

Advantageously also, each retaining means comprises an outer part abutting at least one of said tubes, an inner part abutting the outer surface of at least one tile, and adjustment means for adjustably spacing the outer and inner parts relative to each other. Preferably, the adjustment means comprises a joining screw-threaded pin threadedly engaged within opposed screw-threaded bores in the outer and inner parts, the joining pin being screwed further into or out of the bores to adjust the separation of the parts and allow the abutting force to be controlled.

Advantageously also, sides of the outer part taper outwards and concavely to allow the side to engage between two adjacent tubes of the cage of tubes.

Advantageously also, a recess is formed on the outer side of at least some tiles, the inner part having a rounded nose which engages in said recess thereby preventing the tiles from sliding along the axis of the body.

In a preferred embodiment, joining means are provided at the joins of the tiles to further secure the tiles together. Preferably the joining means is a dowel which mates in complementary bores in the adjacent sides of abutting tiles; and for ease of assembly and dismantling of the tiles, the uppermost tile, in use, and those adjacent thereto are rebated at the mutually abutting sides instead of having dowels.

An embodiment of the invention will now be described, by way of example only, with reference to the following drawings, in which.

Figure 1:
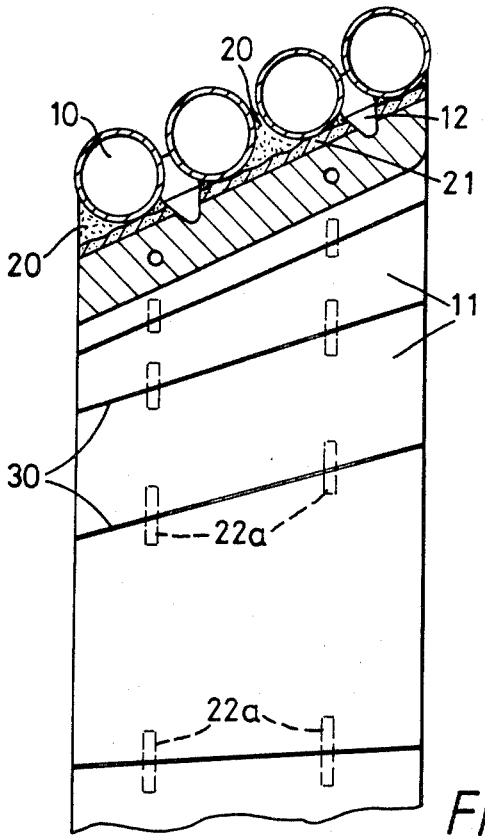
FIG. 1 is a fragmentary axial sectional view of a burner throat.

Referring to FIG. 1, the throat (generally representing a body) comprises a bank of spaced tubes 10 normal to the throat axis and tapering thereof in their formation from the front to the back to form a truncated cone.

To protect the tubes from the intense heat and corrosion, fitting refractory tiles 11 inwardly line the tubes 10. The tiles 11 are secured in position by a plurality of adjustable retaining means 12 located between the tiles 11 and tubes 10 and exerting an abutting force radially inwards on the tiles 11 to retain them in position.

Figure 3:
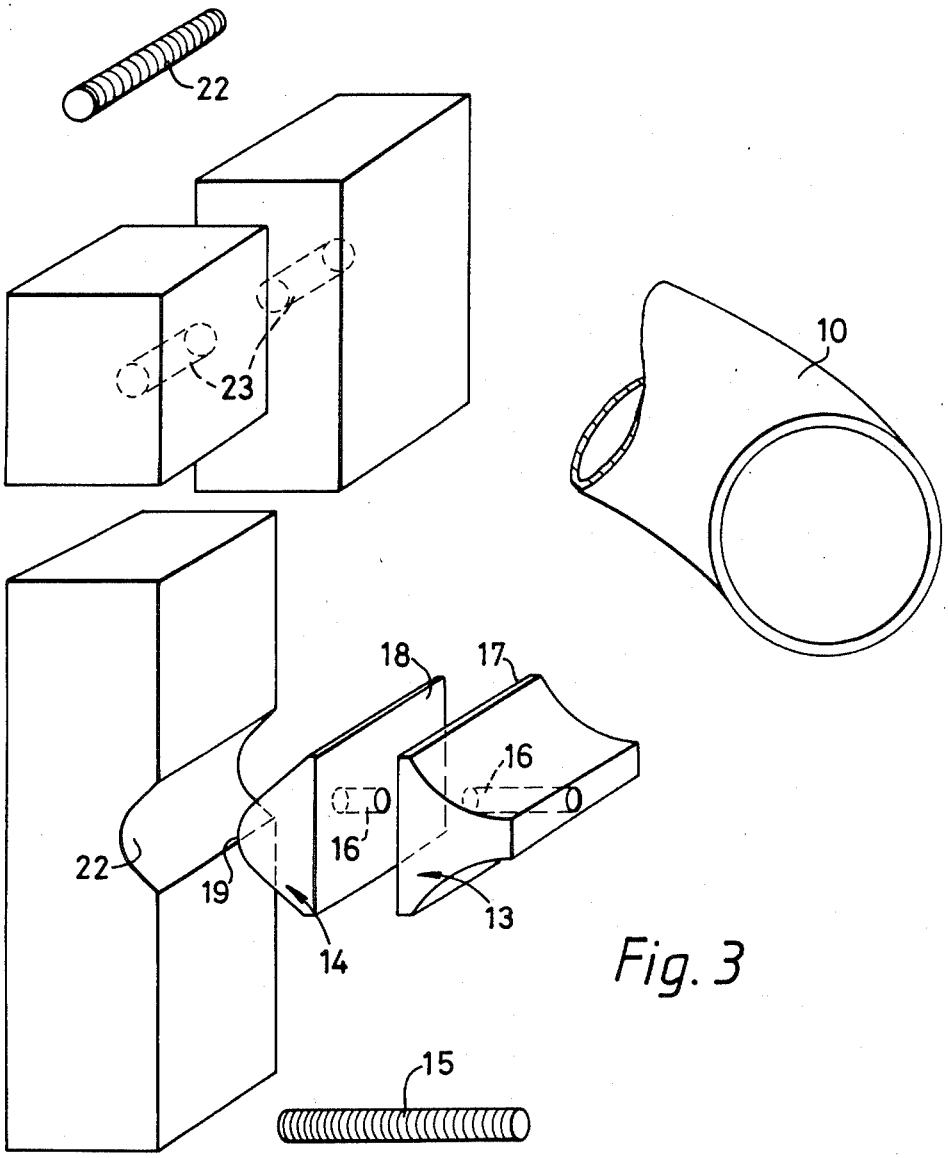
FIG. 3 is a greatly enlarged exploded perspective view of a portion of the burner throat.

As shown in FIG. 3, each retaining means comprises an outer part 13 and an inner part 14 joined by a screw-threaded pin 15 threadedly engaging opposed threaded bores 16 formed in the parts 13 and 14.

The part 13 tapers outwards from a first face 17 in an arcuately concave manner so as to engage between adjacent spaced tubes 10, while the inner part 14 tapers inwardly from a second face 18, opposing the first face 17, to a rounded nose 19. Another embodiment may involve a saddle (not shown) in place of the concave sides of the outer part, so as to straddle and engage round a pipe 10.

As shown in FIG. 1, once in position the retaining means 12 are closed between a high alumina plastic refractory filling 20, fireclay bedding mortar 21 then being applied over the tubes as a base setting compound for the tiles 11. Each nose 19 extending from the surface of the bedding mortar 21 engages fully in a complementary recess 22 on the outer side of a tile 11 thereby preventing same from sliding axially along the throat.

By screwing the joining pin 15 further into or out of the bores 16, the separation between the parts 13 and 14 is adjusted thereby allowing the abutting force exerted in use by the retaining means 12 to be controlled to suit the prevailing design and environment.

In a preferred embodiment, joining means **22*a* represented by dowels are provided to mate in complementary bores 23 formed in the adjacent sides of the abutting tiles 11 to hold the tile assembly more securely together. As shown in FIG. 3, all save the tile 24 twelve o'clock position have these joining means 22*a*. This tile 24 is gravity supported: the joining edges are rebated 25 having an extending chin 25 to engage on the shoulder 27 of the adjacent tiles in the eleven o'clock and one o'clock positions, defined 28 and 29 respectively, thereby allowing for easier assembly and disassembly of the tiles 11**.

Figure 2:
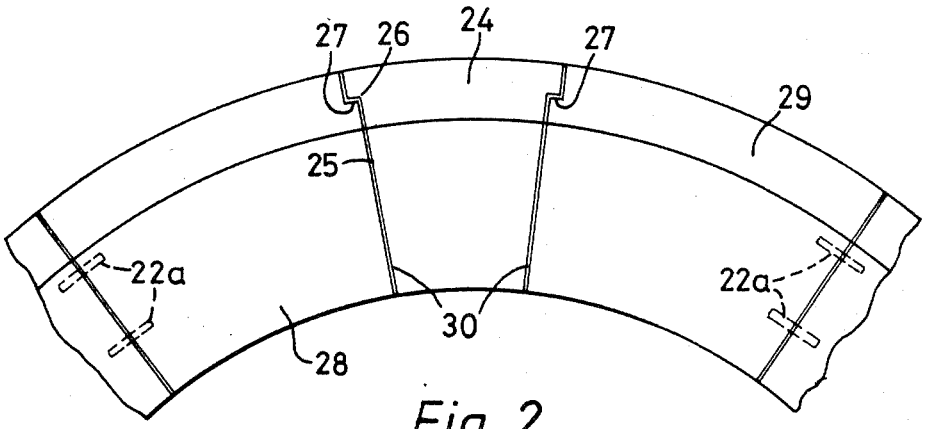
FIG. 2 is a fragmentary view along the axis of an assembly of tiles lining the burner throat.

During assembly ceramic fibre paper flush (not shown) fills the tile joints 30 (FIGS. 1 and 2) to form a full depth construction joint gasket.

As will be realised, the first aspect of the invention can be used for other applications other than a burner throat, the criterion being that the body (in this embodiment a burner throat) which the tiles line, should be generally arcuate so that each tile abuts its neighbour for relative self-support.

I claim:

1. A generally arcuately shaped body comprising a generally arcuate cage of tubes in which access to the cold side thereof is restricted; an inner lining of fitting refractory tiles laid in circular courses along the axis of the arcuate cage of tubes; each course having a plurality of joining means between abutting tile edges to prevent relative movement of said tile edges; the arcuately shaped body having a plurality of non-permanently fixed and adjustable retaining means located between the tubes and tiles so as to exert an abutting force radially inwards on the tiles and thereby retain them in position.

2. A generally arcuately shaped body according to claim 1 wherein the joining means is a dowel which mates in complementary bores in said abutting edges of adjacent tiles; and for ease of assembly and dismantling of the tiles, the uppermost tile, in use, and those adjacent thereto are rebated at the mutually abutting sides, instead of having dowels.

3. A generally arcuately shaped body according to claim 1 where in the arcuately shaped body is a burner throat, the contact between the retaining means and tiles being such as to prevent the tiles slipping along the axis of the throat.

4. A generally arcuately shaped body according to claim 3 wherein a recess is formed on the outer side of at least some tiles, the inner part of the retaining means having a rounded nose which engages in said recess thereby preventing the tiles from sliding along the axis of the body.

5. A generally arcuately shaped body according to claim 1 wherein each retaining means comprises an outer part abutting at least one of said tubes, an inner part abutting the outer surface of at least one tile, and adjustment means for adjustably spacing the outer and inner parts relative to each other.

6. A generally arcuately shaped body according to claim 5 wherein the adjustment means comprises a joining screw-threaded pin threadedly engaged within opposed screw-threaded bores in the outer and inner parts, the joining pin being screwed further into or out of the bores to adjust the separation of the parts and allow the abutting force to be controlled.

7. A generally arcuately shaped body according to claim 6 wherein the sides of the outer part taper outwards and concavely to allow the sides to engage between two adjacent tubes of the cage of tubes.

* * * * *